United States Patent [19]

Stijntjes et al.

[11] 4,431,979

[45] Feb. 14, 1984

[54] SYNTHETIC RESIN-BONDED ELECTROMAGNETIC COMPONENT AND METHOD OF MANUFACTURING SAME

[75] Inventors: Theodorus G. W. Stijntjes; Cornelis J. Esveldt, both of Eindhoven, Netherlands

[73] Assignee: U.S. Philips Corporation, New York, N.Y.

[21] Appl. No.: 283,399

[22] Filed: Jul. 15, 1981

[30] Foreign Application Priority Data

Jul. 22, 1980 [NL] Netherlands ..... 8004200

[51] Int. Cl.[3] ..... H01F 7/00

[52] U.S. Cl. ..... 335/210; 252/62.54; 264/DIG. 58; 148/31.55

[58] Field of Search ..... 335/210, 302, 303; 252/62.54, 62.58, 62.64; 264/61, DIG. 58; 148/31.55, 31.57

[56] References Cited

U.S. PATENT DOCUMENTS

| | | | |
|---|---|---|---|
| 3,677,947 | 7/1972 | Ray et al. | 252/62.54 |
| 3,829,806 | 8/1974 | Lathouwers | 335/210 X |
| 3,913,042 | 10/1975 | Talsma | 335/210 |
| 4,001,363 | 1/1977 | Koppens | 264/DIG. 58 |

*Primary Examiner*—George Harris
*Attorney, Agent, or Firm*—Norman N. Spain

[57] ABSTRACT

An electromagnetic component on the basis of a sintered, oxidic material having soft-magnetic properties obtained by compressing in a mould sintered soft-magnetic prefilled bodies, preferably having the shape of rods, in such manner that they are in contact with a part of their surfaces and filling the remaining cavities with a mixture of a synthetic resin binder with a soft-magnetic powder.

12 Claims, 2 Drawing Figures

SYNTHETIC RESIN-BONDED ELECTROMAGNETIC COMPONENT AND METHOD OF MANUFACTURING SAME

The invention relates to an electromagnetic component on the basis of a sintered oxidic material having soft-magnetic properties with a synthetic resin as a binder.

Soft-magnetic products manufactured by means of the known ceramic methods from metal oxides or the corresponding metal salts are preferred to metal-based cast soft-magnetic products because of their high electrical resistance and low losses resulting therefrom, especially at high frequencies. However a great disadvantage of these ceramic products is the rather poor dimensional stability as a result of the variations in shrinkage which occur during the sintering step. This usually makes an aftertreatment such as grinding necessary, which is undesired for cost and for technical reasons, in particular in the case of so-called yoke rings for deflection units which are connected to the neck of display tubes for television sets. This aftertreatment is particularly undesirable because it sometimes impairs the magnetic properties of the product, and in addition there is a high reject percentage due to fracture or damage.

An aftertreatment may be omitted if the magnetic material is introduced into a mould (for example by injection moulding) as sintered particles mixed with a binder and the binder is then allowed to cure (at room temperature or at most a few hundreds degrees Centigrade. Actually, the tolerances on the dimensions are determined by the tolerances on the mould dimensions.

A second advantage of this method is that very complicated shapes can also be made.

This method is already known from the literature, for example, where it relates to shaping soft-magnetic products from ferrites, for example, coil cores (see Netherlands Patent Application No. 6608192 laid open to public inspection). However, the permeability ($\mu$) of such cores proves to be unacceptably low for most applications.

As a matter of fact, a soft-magnetic, synthetic plastics material-bonded product, has the following important disadvantage: since the binder material in the product is non-ferromagnetic ($\mu=1$, so-called air $\mu$) and it is present among the magnetic particles, all these particles are in fact separated by air gaps and this results in a dramatic reduction of the effective $\mu$ of the product. This reduction is so large that the intrinsic $\mu$ of the magnetic material only plays a minor role.

It is the object of the invention to provide an electromagnetic component on the basis of a sintered oxidic material having soft-magnetic properties with a synthetic resin as a binder, which component has a permeability which is high for synthetic resin-bonded electromagnetic components, preferably in combination with a high electrical resistance, and to provide a method of manufacturing such a component.

For that purpose, an electromagnetic component of the kind described in the opening paragraph is characterized in that it comprises a structure of densely packed pre-shaped sintered bodies of oxidic material having soft-magnetic properties which are united by means of a synthetic resin binder system containing a soft-magnetic powder and filling the cavities between the bodies to form a solid body having an accurately defined shape and dimensions. Densely stacked is to be understood to mean herein that each of the sintered body has mechanical contact with the greatest number possible of adjacent bodies.

The advantages which the present invention presents are illustrated as follows:

When an annular mould is filled with sintered ferrite balls ($\phi$ approximately 2 mm), and when a filling as dense as possible is ensured, for example, by vibration (a densest ball stack is most ideal) and when said ring is then filled with a thermoplastic resin a $\mu_{eff}$ of 13 is measured after cooling in such a ring (in a solid compressed and sintered ring of this ferrite a $\mu$ of approximately 350 has been measured). When, however, the cavities between the balls are filled with a mixture of iron powder and a thermoplastic resin said uff increases from 13 to 35.

Still a better result is obtained when the balls after prefilling, and during the injection of the mixture, are fixed by keeping them under a certain pressure. A $\mu$ of 45–50 can thus be easily obtained.

In the above paragraphs the essential features of the method according to the invention have actually been described already, namely 1. prefilling a mould with sintered soft-magnetic bodies of given shapes (see hereinafter) to an as dense as possible stacking.
2. keeping these bodies in their original positions during the injection into the mould of a soft-magnetic material (metal powder or ceramic powder) with a binder (thermoplastic or thermohardening).
3. the injection pressure may not be so high that the bodies are forced apart and certainly not so high that they are destroyed by the pressure.

A method of manufacturing an electromagnetic component on the basis of a sintered oxidic material having soft-magnetic properties with a synthetic resin as a binder is therefore characterized according to the invention by the following steps:

providing a number of pre-shaped and sintered bodies of ferrite;

filling a matrix with the pre-shaped bodies;

keeping the pre-shaped bodies in the mould while exerting sufficient pressure on them to ensure that they are mutually in mechanical contact with a part of their surfaces;

mixing a liquid binder with a soft-magnetic powder;

introducing the liquid mixture into the cavities between the pre-shaped bodies in the mould;

curing the binder, in which the binder unites the pre-shaped bodies and the powder to a solid having the shape and dimensions of the mould;

removing the solid from the mould.

As regards the shape of the sintered pre-shaped bodies there are preferred shapes which roughly can be classified in three categories:

a. balls; especially where dense stacking is important.

b. rod-shaped parts such as cylinders, elongate ellipsoids (rice grain shaped), and polyhedrons (length: cross:section$>$2:1). Besides the condition of a good filling, two more conditions must preferably be satisfied in this case, namely: a maximum number of parts must be arranged in the same direction and the stacking must be in masonry bond (like the bricks in a wall).

c. lamellar bodies in which the ratio cross-section:-main face $<\frac{1}{3}$. For this the same conditions apply as mentioned in item b.

It is to be noted that the choice of the shape and dimensions of the particles of the pre-filling fraction is also determined by the shape and dimensions of the final product, for example, when a ring is to be made having a $\phi_{out}$ of 40 mm and a $\phi_{in}$ of 30 mm, no rods should be used having (for example) a length of 20 mm and a $\phi$ of 2 mm since in that case the empty spaces formed are much too large.

The mutual contacts between the pre-shaped bodies are provided by the following:

I. The tangent points of balls.

II. The tangents of cylinders and ellipsoids.

III. The tangent planes of polyhedrons and lamellae.

From the point of view of magnetic "short-circuit", category III is to be preferred but a disadvantage is that the filling of the cavities is less effective.

When particles are used having a large length:diameter ratio, an anisotropic product is obtained when said particles are neatly arranged in the same direction in the body to be formed, a higher $\mu_{eff}$ being obtained than, for example, with balls, provided of course that the field direction is the same as the direction of the largest dimension of the bodies. In this manner a $\mu_{eff}$ of 110 has been realized starting from a basic material having a $\mu=350$. In applications in which this method can be used, the choice of the ferrite composition starts to play a role because in this case a higher $\mu$ of the starting material also gives a significantly higher $\mu$ of the composite body.

The invention will now be described in greater detail, by way of example, with reference to the drawing and a few examples.

COMPOSITIONS OF THE PRE-SHAPED BODIES

Figure 1:
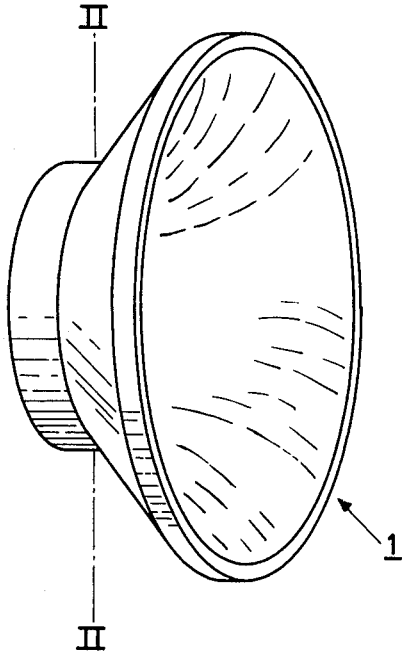
FIG. 1 is a perspective view of a yoke ring for a display tube/deflection unit combination.

In general it is desirable to use a starting material having a comparatively high permeability. Since for many applications the magnetic losses must be low at rather high frequencies (up to 5 Mc) a high electrical resistance ($>5\times10^4$ Ωm) is also required. This type of materials is found in particular in the ferrite systems:

a. MgMnZn-ferrites b. LiMnZn-ferrites c. NiZn-ferrites

The said ferrite systems have roughly the following composition limits (in mol.%):

| | | | | | | | | |
|---|---|---|---|---|---|---|---|---|
| a. | MgO | 20–45 | b. | $Li_2O$ | 5–11 | c. | NiO | 20–40 |
| | MnO | 1–8 | | MnO | 3–10 | | ZnO | 10–30 |
| | $Fe_2O_3$ | 40–49.5 | | ZnO | 15–40 | | $Fe_2O_3$ | 46–50 |
| | ZnO | 5–30 | | $Fe_2O_3$ | 55–75 | | | |

It will be obvious that substitutions of other ions as they are known to those skilled in the art from the literature (see, for example, "Treatise on Materials Science and Technology", Volume 11, p. 408, table 8; New York 1971) may also be used in this case.

For applications in which the losses at very high frequencies are less important, and the value of $\mu_{eff}$ is important, the MnZn ferrites ($\mu>1000$) are preferred. Composition limits (in mol.%):

MnO: 18–40

ZnO: 10–30

$Fe_2O_3$: 50–55

Of course, all kind of substitutions are also possible in this case (see, for example, German Offenlegungsschrift No. 2735440).

In general it should be stated that, of course, other known soft-magnetic ferrites may also be used. The preparation of the ferrites for the preshaped bodies is performed by any of the many methods known to those skilled in the art (see, for example, "Treatise on Materials Science and Technology", Volume 11, p. 411, FIG. 13).

In the last step of the preparation process, namely the sintering step, an extra advantage of the invention appears. The pre-shaped bodies may be sintered in a constant cycle process because the size tolerance plays substantially no role.

COMPOSITION OF THE INJECTION MIXTURE a. The Organic Binder:

For this purpose are to be considered two major groups, namely:

1. thermoplastic materials
2. thermohardening materials

Many representatives of the two groups are known (see, for example, Materials Engin., Jan. 1980, pp. 40–45), the former group is to be considered in particular when the price is an important factor, the second group when the strength of the manufactured component is important.

b. The Soft-Magnetic Filler:

This may also be divided into two major groups:

1. Metal powder having as an example the various types of powder iron as they are commercially available. Requirements: Material permeability reasonably high, grain size distribution within certain limits (these limits are determined by the product to be manufactured and the binder used), but the average grain size will always be small (at most a few microns), because otherwise eddy current losses start playing a role; finally the metal particles must preferably have an electrically insulating layer on the outside (for example, by phosphation).

2. Soft-magnetic ferrite powders. In this case also the requirement holds that the $\mu$ of the powders must be reasonable. Furthermore, an average grain size between approximately 1 and 10 μm is desired for these powders for technical processing reasons.

See further example number F.

The volume ratio in which the magnetic powder and the binder are mixed may vary within certain limits (2:3–3:2), the lower limit being determined by the magnetic characteristics of the mixture, and the upper limit by the mouldability of the mixture and the mechanical properties of the final product.

For highly permeable products, an easy path for the magnetic flux from particle to particle is essential, in other words air gaps immediately reduce the permeability, and therefore a prefilling of a mould with coarse particles succeeded by injection moulding in which said particles are kept under pressure, is the proper course to achieve acceptable results.

EXAMPLE A

Balls were formed from a magnesium zinc manganese ferrite powder having a composition satisfying the formula $Mg_{0.65}Zn_{0.35}Mn_{0.1}Fe_{1.78}O_{3.82}$ by rolling the powder with a binder solution. The resultant balls were sintered in air at 1320° C. for 2 hours. After sintering the balls had a diameter of 0.6–1.2 mm.

These ferrite balls were poured into a ring-shaped mould having the dimensions $\phi_o=50$ mm, $\phi_i=34$ mm and h=8 mm and then compacted by means of a locking die at a pressure of 40 kg/cm$^2$. The volume filling of the balls was 55%. The remaining 45% by volume were then filled with a mixture of iron powder and epoxy resin plus hardener. This mixture contained 90% by weight of iron powder.

EXAMPLE B

In this case magnesium zinc manganese ferrite balls were used which had been made according to the method of example A but with a diameter after sintering of 2 mm to 2.8 mm.

An injection mould having the same dimensions as that of example A was filled with these balls. The volume filling was 50%. The remaining 50% by volume was filled with a mixture of iron powder and polypropylene (weight percentage of iron powder herein was 90%).

EXAMPLE C

Rods of a manganese zinc ferrous ferrite were prepared by mixing a powder with a binder and water, extrusion of the mixture succeeded by sintering at 1300° C. for 1 hour in $N_2$+5% $O_2$ and then, during cooling, reducing the oxygen partial pressure to 0.1% of $O_2$ at 1000° C. After firing the rods had the dimension $\phi$ 1.65 mm and a length of 9.2 mm.

The mould of example B was prefilled in such a manner that the longitudinal axes of the rods were arranged in the tangential direction of the mould wall as well as possible. The volume filling was 50%. The cavities were then filled with a mixture of iron powder and polypropylene (92% by weight of iron powder in this mixture).

EXAMPLE D

In this example rods of MgZnMn-ferrite (see example A) having the dimension $\phi$ 2 mm×5 mm length were prefilled in a mould (see A) in which the axis of the rods was in the tangential direction as much as possible.

66% by volume of the matrix cavity was occupied by said rods.

The remaining cavities were filled with a mixture of iron powder and thermosetting resin (89% by weight of iron powder in this mixture), in which the prefilled bodies were pressed under a pressure of 40 kg/cm$^2$.

EXAMPLE E

Rods of MnZn ferrous ferrite ($\phi$ 1 mm×5 mm length) were prefilled in a mould (see A) having their axial lengths in the tangential direction of the mould wall, volume filling 70%. After a mixture of iron powder and thermohardener. (54% by volume of iron powder and 46% by volume of thermo-setting resin; i.e. 90% by weight of iron powder).

EXAMPLE F

A mould having the same dimensions as that of example A was prefilled with 56% by volume of balls of MgZnMn ferrite (see example A) $\phi$ 0.4–1 mm. After pressing at approximately 40 kg/cm$^2$, the cavities were filled with a mixture of epoxy resin and MgZnMn ferrite powder having the same composition as the balls, average grain size 1.5 $\mu$m), in which 44% by volume were occupied by ferrite and 56% by volume by the epoxy resin (i.e. 78% by weight of ferrite).

EXAMPLE G

In this example a mould of the same dimensions as that of example A was prefilled with MgZnMn ferrite (see A) flakes up to 42% by volume kept under a pressure of 40 kg/cm$^2$, the remaining cavities were then filled with a mixture of iron powder and epoxy resin (volume ratio 54:46; i.e. 90% by weight of iron powder).

EXAMPLE H

A mould (see previous examples) was prefilled with manganese zinc ferrous ferrite rods ($\phi$ 4.5 mm×length 6 mm), the volume filling being 51%. After pressing with approximately 40 kg/cm$^2$, the cavities were filled with a mixture of epoxy resin and MgZn ferrite powder (average grain size 6 $\mu$m).

The volume ratio epoxy resin/MgZn-ferrous ferrite=37/63, i.e. 88% by weight of ferrite.

The properties of the products obtained according to examples A–H are recorded in the Table below wherein $\mu_i$ is the initial permeability, tg $\delta/\mu$ is the loss factor and $\rho$ is the resistivity.

TABLE

| Example | $\mu_i$ | (tan $\delta/\mu$) × $10^6$ 0.1 MHz | 1 MHz | 4 MHz | $\rho$ in $\Omega$ m |
|---|---|---|---|---|---|
| A | 49 | 106 | 227 | 1700 | $\geqq 10^7$ |
| B | 35 | | | | $\geqq 10^7$ |
| C | 91 | | | | |
| D | 110 | | | | $\geqq 10^7$ |
| E | 148 | | 45 | 950 | |
| F | 41 | | 340 | 2400 | $\geqq 10^7$ |
| G | 32 | 195 | 230 | 790 | $\geqq 10^7$ |
| H | 146 | | 260 | | |

APPLICATION

Figure 2:
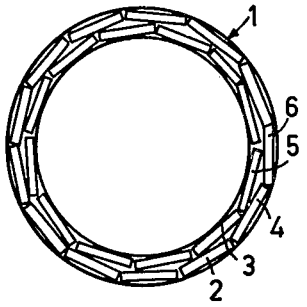
FIG. 2 is a vertical sectional view through the yoke ring of FIG. 1 and shows how the stacking of the sintered rods from which the yoke ring is constructed is conformed to the direction in which the magnetic flux flows through the yoke ring.

Among applications for the electromagnetic components of the invention are coil cores and transformer cores having complicated shapes, and yoke rings for display tube/deflection unit combinations for television sets. An example of a yoke ring according to the invention is shown in FIG. 1 and is referred to by reference numeral 1. The yoke ring 1 has been obtained by pressing elongate rods, 2,3,4,5, 6 etc. (FIG. 2) of MnZn ferrite in a matrix having the shape and dimension of the yoke ring 1 and filling the remaining cavities with a mixture of epoxy resin and MnZn ferrite powder. The rods 2 3, 4, 5, 6 etc. are stacked in a "masonry bond" with their longitudinal axes substantially in the tangential direction of the mould wall so as to make the $\mu$ in this direction as large as possible.

What is claimed is:

1. An electromagnetic component comprising preshaped sintered oxidic bodies having soft magnetic properties bound together by means of a synthetic resin binder composition characterized in that said preshaped sintered bodies are densely packed and in mutual contact with each other and said synthetic resin binder composition contains a soft magnetic powder and fills the cavities between said bodies so as to thereby form a solid body of an accurately defined shape and dimensions.

2. A component as claimed in claim 1, characterized in that the preshaped bodies have substantially the shape of a sphere.

3. A component as claimed in claim 1, characterized in that the preshaped bodies have substantially the shape of a rod.

4. A component as claimed in claim 1, characterized in that the preshaped bodies are lamellar.

5. A component as claimed in claim 3 or 4, characterized in that the axes in the direction of the major dimensions of the preshaped bodies are substantially parallel to the direction in which magnetic flux flows through the component during operation.

6. A component as claimed in claim 3 or 4, characterized in that the preshaped bodies are stacked in masonry bond.

7. A component as claimed in claim 1, characterized in that the soft-magnetic powder belongs to the group comprising ferrite powder and iron powder.

8. A component as claimed in claim 1, characterized in that the oxidic ferromagnetic material belongs to the group comprising MgMnZn ferrite, LiMnZn ferrite, MnZn ferrite and NiZn ferrite.

9. A component as claimed in claim 1, characterized in that it has the form of a ring and that the sintered preshaped bodies are in the form of rods and are directed tangentially with their longitudinal axes.

10. An electromagnetic component of claim 9 particularly adapted for use as an annular core for a deflection unit for a cathode ray tube.

11. A method of manufacturing an electromagnetic component having an accurately defined shape and dimensions on the basis of a sintered oxidic material having soft-magnetic properties with a synthetic resin as a binder, characterized by the following steps:

providing a number of preshaped and sintered bodies of ferrite;

filling a mould with the preshaped bodies;

keeping the preshaped bodies in the mould while exerting sufficient pressure on them to ensure that they are in mechanical contact with a part of their surfaces;

mixing a liquid binder with a soft-magnetic powder;

introducing the liquid mixture into the cavities between the preshaped bodies in the mould;

curing the binder, in which the binder unites the preshaped bodies and the powder to a solid having the shape and dimensions of the mould;

removing the solid from the mould.

12. A yoke ring of soft magnetic material for use in an electron beam deflection unit, said yoke ring having a substantially frustoconical shape, characterized in that it comprises a structure of densely packed preshaped soft magnetic bodies which are united into a solid body by means of a synthetic resin binder system which contains a soft magnetic powder and fills the cavities between the bodies.

* * * * *